US006999037B2

(12) United States Patent
Apostolos

(10) Patent No.: US 6,999,037 B2
(45) Date of Patent: Feb. 14, 2006

(54) MEANDER-LINELESS WIDE BANDWIDTH L-SHAPED SLOT LINE ANTENNA

(75) Inventor: John T. Apostolos, Merrimack, NH (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/803,685

(22) Filed: Mar. 18, 2004

(65) Prior Publication Data

US 2005/0206572 A1 Sep. 22, 2005

(51) Int. Cl.
*H01Q 13/10* (2006.01)

(52) U.S. Cl. ..... 343/767; 343/702; 343/846

(58) Field of Classification Search ..... 343/767, 343/770, 702, 846
See application file for complete search history.

(56) References Cited

U.S. PATENT DOCUMENTS 5,790,080 A 8/1998 Apostolos ..... 343/744
6,313,716 B1 11/2001 Apostolos ..... 333/162
6,323,814 B1 11/2001 Apostolos ..... 343/744
6,373,440 B1 4/2002 Apostolos ..... 343/744
6,373,446 B1 4/2002 Apostolos ..... 343/797
6,404,391 B1 6/2002 Apostolos ..... 343/700 MS
6,480,158 B1 11/2002 Apostolos ..... 343/700 MS
6,492,953 B1 12/2002 Apostolos ..... 343/744
6,590,543 B1 7/2003 Apostolos ..... 343/742
6,750,821 B1 * 6/2004 Fang et al. ..... 343/700 MS
6,839,036 B1 * 1/2005 Apostolos et al. ..... 343/770

OTHER PUBLICATIONS

PCT International Search Report dated Sep. 23, 2005 of International Application No. PCT/US05/05382 filed Feb. 18, 2005.

* cited by examiner

*Primary Examiner*—Hoang V. Nguyen
(74) *Attorney, Agent, or Firm*—Robert K. Tendler

(57) ABSTRACT

An asymmetric slotted L-shaped antenna is provided with a wide bandwidth in an exceedingly small size with good gain across the entire bandwidth by shorting out one end of the slot and by providing a capacitor at the other end of the slot, with the result that with appropriate capacitance, spacings and dimensions, the impedance of the slotted transmission line cancels the reactance of the antenna such that the gain of the antenna can be made to match a similar sized meander line loaded antenna.

20 Claims, 4 Drawing Sheets

MEANDER-LINELESS WIDE BANDWIDTH L-SHAPED SLOT LINE ANTENNA

FIELD OF THE INVENTION

This invention relates to miniaturized broad bandwidth antennas and more particularly to an asymmetric slotted L-shaped antenna having a shorting stub at one end of the slot and a capacitor shunting the other end of the slot.

BACKGROUND OF THE INVENTION

Meander line loaded antennas are known and are exemplified by U.S. Pat. Nos. 5,790,080; 6,313,716; 6,323,814; 6,373,440; 6,373,446; 6,480,158; 6,492,953; 6,404,391 and 6,590,543. These patents are assigned to the assignee hereof and are included herein by reference.

In all of the prior meander line loaded antennas there is a right angle between the horizontal and vertical radiators, with the top plate being parallel to the ground plane plate utilized. This plate configuration optimizes the current distribution for maximum bandwidth.

As illustrated in the above patents, in order to make reduced-sized or miniaturized antennas, a meander line has been utilized to load the antenna in such a manner that the size of the antenna can be diminished while at the same time providing for a relatively wide bandwidth response for the antenna.

As illustrated in U.S. patent application Ser. No. 10/123,787 filed Apr. 16, 2002 entitled "Method and Apparatus for Reducing the Low Frequency Cut-off of a Wideband Meander Line Loaded Antenna" by John T. Apostolos, an L-shaped antenna is provided in which a vertical upstanding plate orthogonal to a ground plane is spaced from a horizontally-extending plate parallel to the ground plane, with the signal to the antenna being applied between the ground plane and the upstanding plate. Here, a capacitive member or cap bridges the slot or gap between the upstanding plate and the horizontal plate. It has been found that the utilization of the capacitor over the gap contributed substantially to the lowering of the low frequency cut-off of the wideband meander line loaded L-shaped antenna.

As with all meander line loaded antennas, a significant cost to the antenna is the provision of the meander line itself, which requires spaced-apart plates or strips which provide for an impedance discontinuity that in effect lengthens the overall size of the antenna while at the same time keeping the antenna small due to the folded meander line configuration. In practice, these meander lines are separately fabricated and are attached to or positioned adjacent the vertical and horizontal plates making up the L-shaped antenna. The separate fabrication of the meander line not only complicates construction of the antenna but also is somewhat costly to manufacture.

When such antennas are to be used, for instance, in cellular phone antennas, or with personal digital assistants or PDAs, it is important that these antennas not only work in the 830 MHz cellular band but also in the PCS bands, either 1.7 GHz or 1.9 GHz. Thus it is important that a single miniature antenna be able to operate effectively in these two bands. More particularly, each of these two bands is subdivided into two bands such that for PDA applications, it is important to have an antenna which has acceptable gain in each of the four bands of operation.

In another application, the so-called ultra-wideband service, these antennas must work from, for instance, 3 GHz to 9 GHz with an acceptable gain across the entire band. This service involves spread spectrum signaling in which miniscule amounts of energy are "smeared out" across the entire band through which the energy is swept. The purpose of the use of ultra-wideband is to make it possible to use bands for which there is already an allocated use. The ultra-wideband transmissions are said to be of such a small magnitude that they do not contribute substantially to interference with the normal signals in these bands.

It is therefore necessary for PDA applications, cellular applications and indeed ultra-wideband applications that a miniaturized antenna be provided which is simple to manufacture and is cost effective. With more than 20 million cell phones currently activated in the United States, the ability to provide new equipment for these cellular and PCS applications requires an extremely simple antenna system which is cost effective to manufacture and can be easily replicated for mass production of such equipment.

Many of the PDAs, cell phones or wireless transceivers are provided in a hand-held package having a clamshell configuration. It is therefore important to be able to provide a wideband antenna which can be housed in the top clamshell that is flipped open to expose an underlying keypad and display.

While in operation the back of such a hand-held device is covered with one's hand, the flipped-up portion of the clamshell is not covered during normal operation. It is therefore important to be able to provide an antenna which is housable in the upper clamshell and which has sufficient gain across the bands of interest so that, for instance, PCS and cellular PDAs can operate in a robust manner.

In the past, for multi-band coverage wireless handset manufacturers have utilized stacked patch antennas, each tuned to a different band and located one on top of the other.

However, such stacking of patch antennas is problematic because the antennas interfere one with the other, thus precluding the requisite gain in each of the four bands. Moreover, in order to get an antenna to operate in ultra-wideband devices between 3 GHz and 9 GHz with sufficient gain over the entire bandwidth, other than meander line loaded antennas, there is presently no miniaturized antenna available for such hand-held units.

While meander line loaded antennas have been suggested for such applications, the cost of the meander line can double the cost of the antenna, which while providing for the requisite characteristics, is a relatively expensive solution.

SUMMARY OF INVENTION

Rather than providing a wide bandwidth meander line loaded antenna for the miniaturized and wideband characteristics thereof, in the subject invention the action of the meander line is duplicated by removing the meander line and providing an asymmetric slot line L-shaped antenna with a shorting stub at one end of the slot and a capacitive coupling shunting the other end of the slot. It has been found that such an antenna can be configured so as to completely mimic the characteristics of the corresponding meander line loaded antenna, size by size. Thus, meander line loaded antenna gain can be achieved across a band between 830 MHz and 1.9 GHz without having to use a meander line. This is due to the fact that an equivalent circuit for the meander line loaded antenna can be formed by shorting the slot in an L-shaped antenna at one end of the slot and by using a capacitive coupling across the other end of the slot as a shunt.

What this means is that a miniaturized wide bandwidth antenna can be fabricated with a simplified L-shaped slotted antenna above a ground plane, with the antenna having its signal fed between the ground plane and the bottom edge of the upstanding or vertical plate of the L-shaped antenna.

By providing a moveable shorting stub at one end of the slot and an L-shaped capacitor at the other end of the slot, one has a situation in which one is feeding the center of the antenna at the center of the slot with two balanced lines. The left-hand balanced line is shorted at one end to provide one part of the requisite impedance, with the other balanced line providing its component to the impedance by using a shunt capacitor at the distal end of this balanced line.

The distance of the shorting stub along the slot can be varied to vary its contribution to the impedance of the slotted transmission line, with the size of the L-shaped capacitor and its position to the other side of the center of the antenna also controlling its portion of the impedance at the feed point to the antenna.

It has been found that by moving the shorting stub at one side of the slot and by specially configuring a capacitor at the other end of the slot, one can obtain antenna gains identical to those of a corresponding meander line loaded antenna without having to use a meander line. Note that the capacitor can be configured in terms of the shape of the L-shaped capacitor, its spacing from the horizontal and vertical elements of the antenna and its spacing from the other end of the slot. As a result, the impedance that exists at the slotted transmission line can be set to zero at the quarter wave point for the antenna at which the antenna reactance is zero. As one increases frequency, the antenna reactance and the feed impedance go in opposite directions from this zero point and cancel each other so as to limit the VSWR of the antenna across the entire bandwidth. This action is quite similar to the action in prior meander line loaded antennas and is achieved without the utilization of a meander line coupled between the vertical plate and the horizontal plate of an L-shaped antenna.

Tuning of the antenna is accomplished by the sliding of the shorting stub at one end of the slot line antenna, whereas the tuning is also accomplished by the shape of the L-shaped capacitor, by its position relative to the other end of the slot and by the spacing of the L-shaped capacitor from the adjacent vertical and horizontal plates of the L-shaped antenna.

In an effort to provide a miniaturized antenna which works down to 830 MHz to cover one of the cellular bands, in one embodiment the base of the upstanding plate is shorted by a shunt to the ground plane. What this does is to decrease the VSWR at the low end of the band at 830 MHz while at the same time raising the VSWR to 4:1 at, for instance, 1600 MHz, a frequency at which the antenna is not designed to operate. At 1.7 GHz and 1.9 GHz, the VSWR goes down enough to a provide sufficient gain for robust broadbanded operation.

In the case of ultra-wideband service, the band from 3 GHz to 9 GHz is easily accommodated by this asymmetric, meander-lineless, shorted and capacitively-shunted L-shaped slot line antenna.

The result is that the miniature size of the antenna can be maintained even when not using a meander line. In one embodiment the overall size of the cavity of the PDA case to house the antenna does not exceed 1.7 inches by 3 inches by ¼ inch, a size readily accommodated in the top clamshell of a hand-held wireless device.

While the subject antenna has been described in terms of hand-held devices, the subject asymmetrical L-shaped antenna can be utilized in any application for which a cost effective wideband antenna is needed.

As a part of the subject invention it has therefore been found that the same type of antenna reactance, feed impedance cancellations to provide wide bandwidth are mimicked by the meander-lineless configuration described herein.

In summary, an asymmetric slotted L-shaped antenna is provided with a wide bandwidth in an exceedingly small size with good gain across the entire bandwidth by shorting out one end of the slot and by providing a capacitor at the other end of the slot, with the result that with appropriate capacitance, spacings and dimensions, the impedance of the slotted transmission line cancels the reactance of the antenna such that the gain of the antenna can be made to match a similar sized meander line loaded antenna.

BRIEF DESCRIPTION OF THE DRAWINGS

These and other features of the subject invention will be better understood in connection with a Detailed Description, in conjunction with the Drawings, of which.

DETAILED DESCRIPTION

Figure 1:
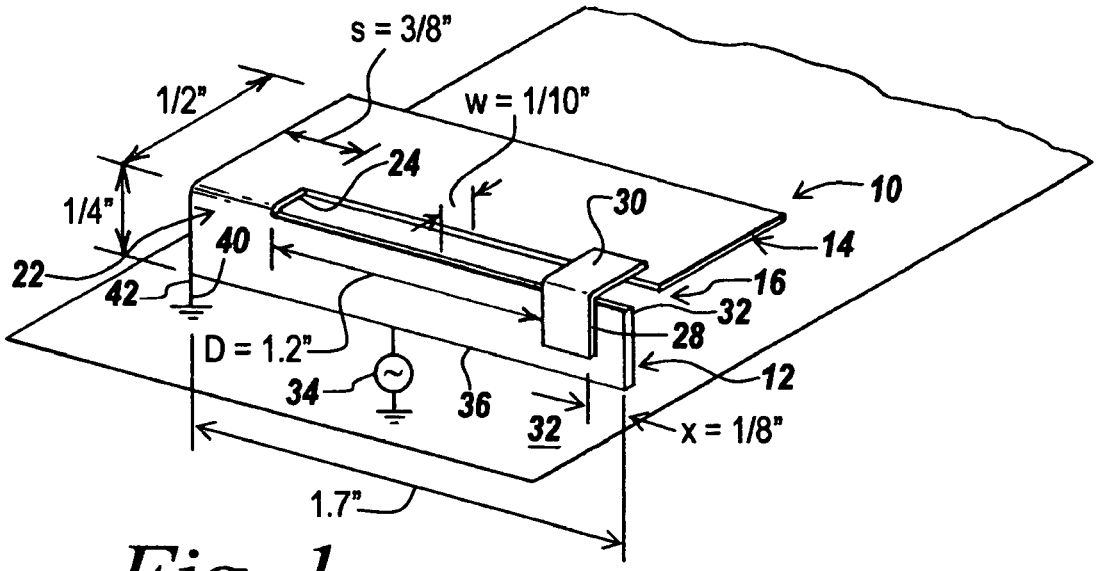
FIG. 1 is a diagrammatic illustration of the asymmetric slotted L-shaped antenna, showing the vertically and horizontally extending L-shaped portions of the antenna, with the left-hand portion of the slot being shorted at a predetermined distance from the left edge thereof and with the right-hand portion of the slot being overlain with an L-shaped capacitive coupling element spaced from the surfaces of the vertically and horizontally extending L-shaped radiators.

Referring now to FIG. 1, an asymmetric L-shaped slot line antenna 10 is comprised of a vertically extending plate 12 meeting a horizontally extending plate 14 at a slot 16 which is formed by edges 18 and 20 of plates 12 and 14.

Slot 16 is shorted at 22 which bridges slot 16 a distance S from edge 24 of plate 14. The width of slot 16 is designated W, whereas the distance from edge 24 of short 22 to edge 26 of L-shaped capacitive member 30 is designated D. It is noted that right-hand edge 28 of capacitive element 30 is spaced a distance X=⅛ inch from edge 32 of upstanding plate 12.

The asymmetric slot line antenna structure 10 is positioned above a ground plane 32 and is driven by signal source 34 between ground plane 32 and edge 36 of vertical plate 12.

In one embodiment especially useful for the cellar and PCS applications, the length of horizontally extending plate 14 is ½ inch, whereas the width of plate 14 is 1.7 inches to match the width of vertically extending plate 12. The distance from edge 24 of short 22 is ⅜ inch, whereas the distance D is approximately 1.2 inches from edge 24 of slot 16 to edge 26 of capacitive element 30. In this case X, the distance of edge 28 to edge 32, is equal to ⅛ inch.

In order to decrease the VSWR at the low frequency end of this antenna, a shunt 40 runs between corner 42 of plate 12 and ground plane 32.

Figure 2:
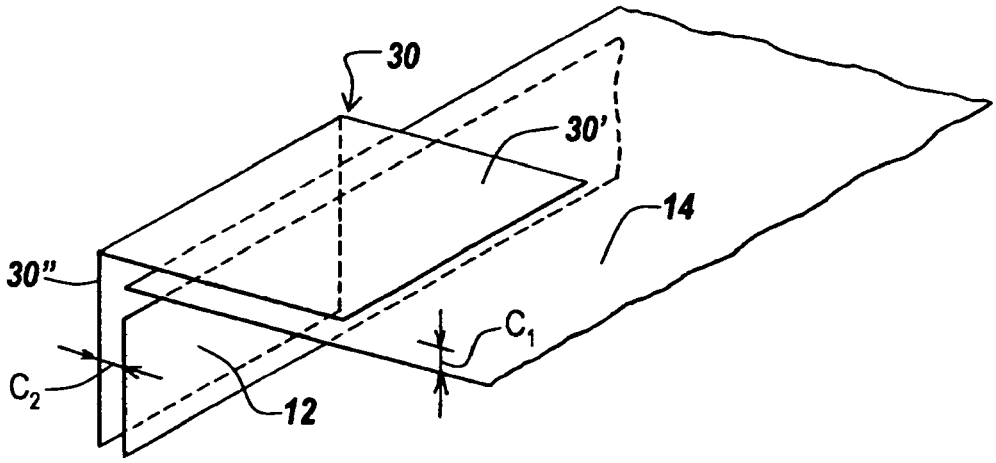
FIG. 2 is a diagrammatic illustration of the critical dimensions of the capacitive coupling showing the area of the L-shaped capacitive element, the spacing of the top plate of the capacitor relative to the horizontally extending radiator of the L-shaped antenna of FIG. 1 and the spacing of the vertical portion of the capacitive element from the vertically extending radiator of the L-shaped antenna of FIG. 1.
Figure 3:
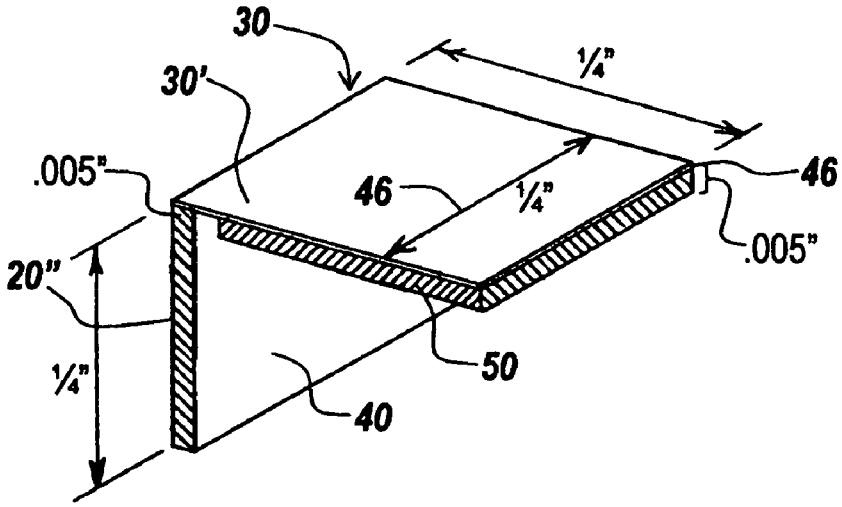
FIG. 3 is a diagrammatic illustration of the interposition of insulation between the under surfaces of the L-shaped capacitive element and the corresponding surfaces of the horizontally running and vertically extending portions of the L-shaped antenna of FIG. 1.

Referring to FIG. 2, capacitive element 30 has a horizontal portion 30' and a vertical portion 30" having respectively areas $A_1$ and $A_2$. In the illustrated embodiment and as illustrated in FIG. 3, one dimension of each of the portions of the capacitive element are ¼ inch. Note that portion 30' is spaced from plate 14 by an amount to yield a capacitance $C_1$, whereas portion 30" is spaced from plate 12 so as to yield a capacitance $c_2$.

In terms of the embodiment shown in FIG. 3, insulating material 48 and 50 is positioned between the various plates of capacitive element 30 and respective horizontal and vertical portions of the L-shaped antenna, with the insulating material having a thickness of 0.05 inches in one embodiment.

Figure 4:
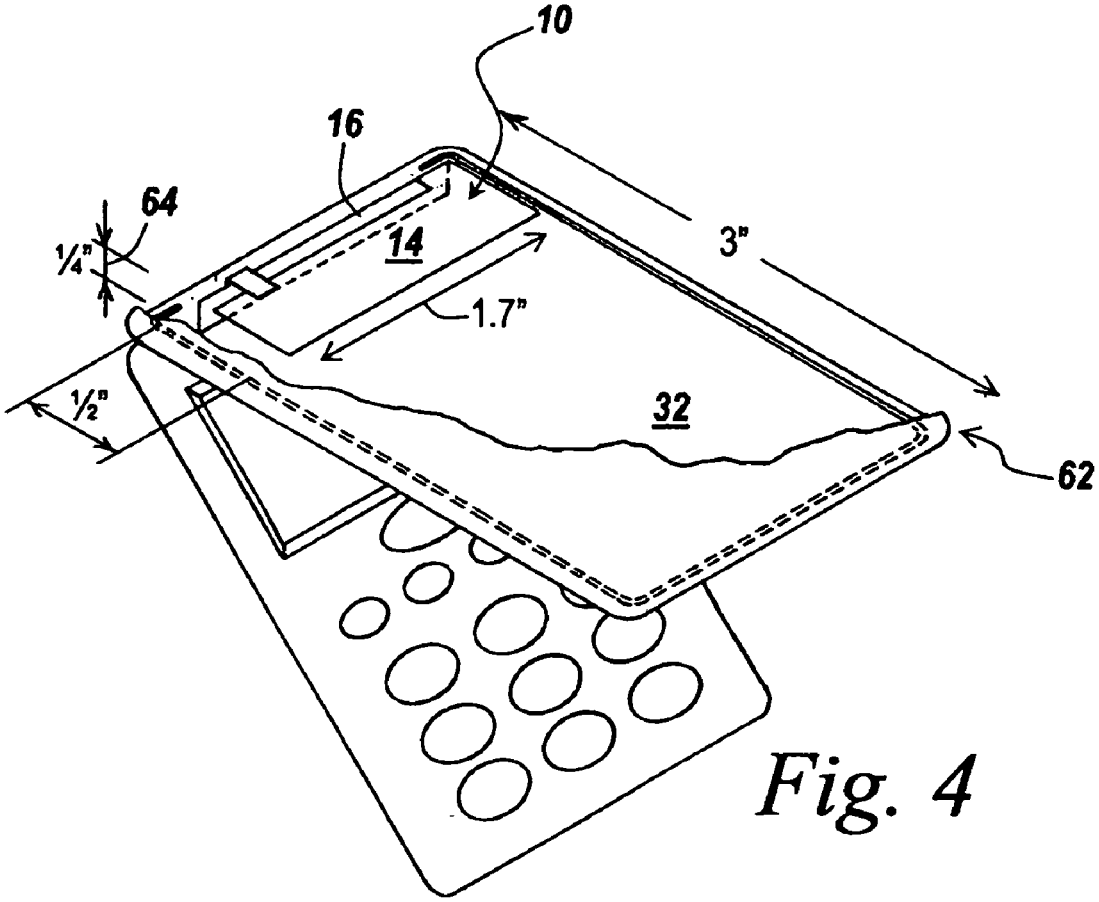
FIG. 4 is a diagrammatic illustration of the mounting of the miniaturized wideband L-shaped asymmetric slot line antenna of FIG. 1 within the upper clamshell of a hand-held device which may be either a wireless phone or a PDA.

Referring now to FIG. 4, a handset 60 may be provided with an upper clamshell 62, which houses antenna 10 as illustrated. Here the horizontally extending plate of the asymmetric L-shaped antenna is illustrated at 14, whereas the vertically extending plate is illustrated at 16. The width of plate 14 is 1.7 inches as illustrated in FIG. 1, whereas the height of plate 16 is ¼ inch as illustrated by a double-ended arrow 64. Note that ground plane 32 is 3 inches long by 1.7 inches wide, making the entire wide bandwidth meander-lineless antenna fit within upper clamshell 62.

Figure 5:
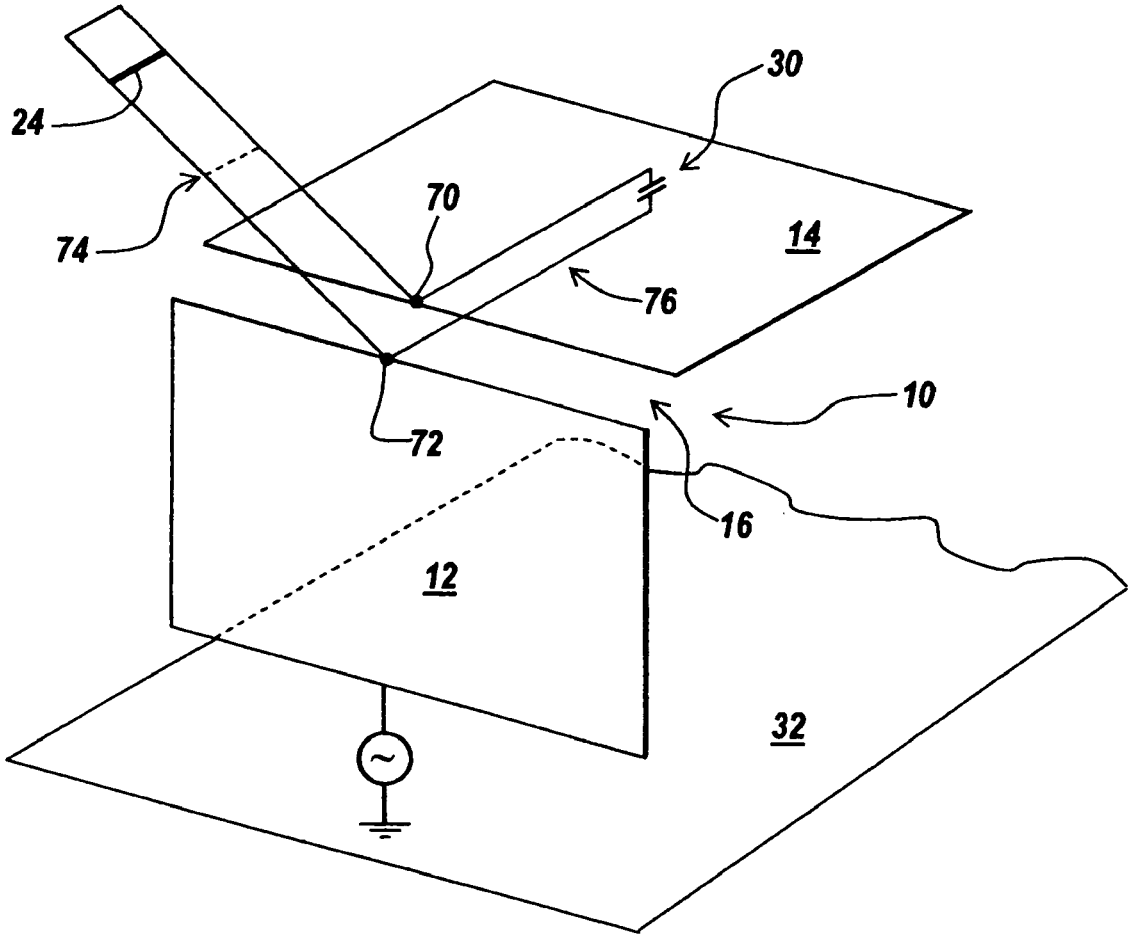
FIG. 5 is a diagrammatic illustration of an equivalent circuit for the asymmetric feed of the L-shaped antenna of FIG. 1, illustrating a shorted balanced line to the left of the center feed of this antenna and a capacitive shunted balanced line to the right of the center feed of this antenna.

Referring to FIG. 5, in which like elements have like reference characters vis-à-vis FIG. 1, the asymmetric feed for the L-shaped antenna 10 can be thought of as feeding the center points 70 and 72 of opposed plates 12 and 14 with a left-hand balanced line 74 and a right-hand balanced line 76. The left-hand balanced line is shorted by a shorting stub 24, whereas right-hand balanced line 76 is shunted by capacitive element 30.

What this shows is that the impedance of the slotted transmission line is a combination of the impedance provided by the left-hand balanced line which is shorted and the right-hand balanced line which is capacitively shunted.

It can be shown that with proper configuration, such an antenna can be provided with a null result of slot line impedance and antenna reactance at the quarter-wave resonance point. Thereafter, with increasing frequency, the slot line impedance cancels the antenna reactance. Note that the impedance of the slot line is given by $Z_o=60\pi^2/(\ln 16 L/W)-1$, where W is the width of the slot and L is the length of the slot.

Figure 6:
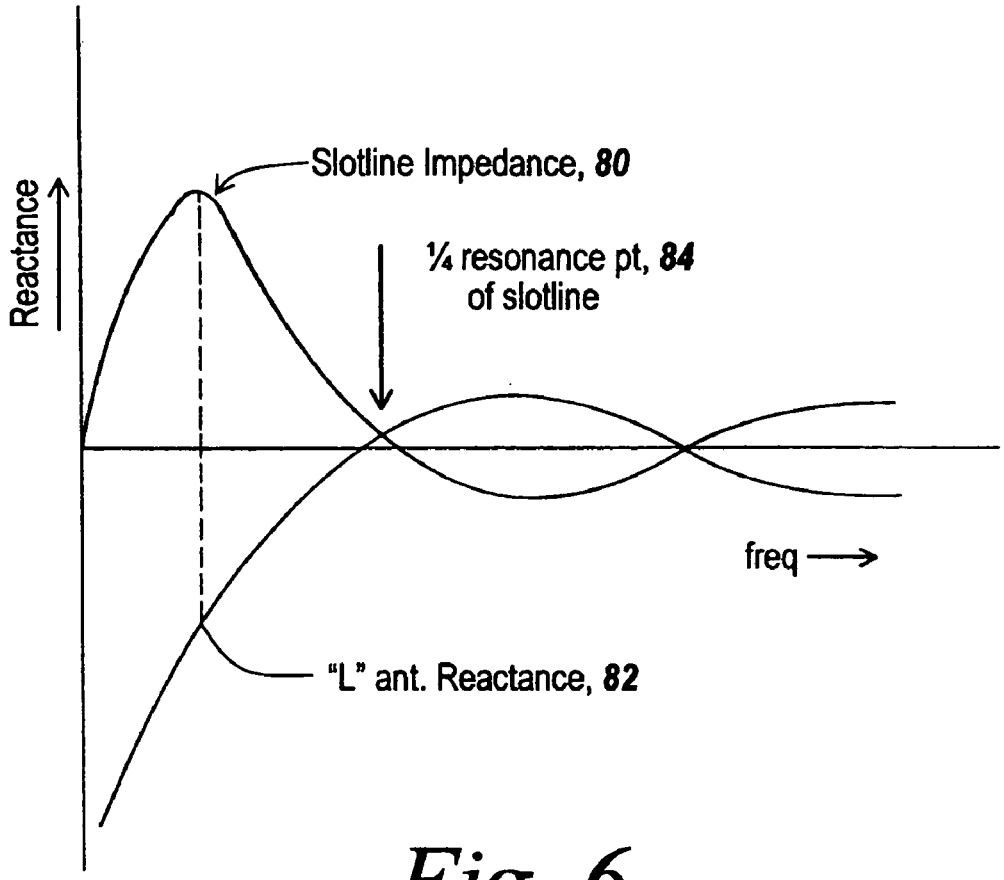
FIG. 6 is a graph of reactance versus frequency, graphing slot line impedance and antenna reactance of the asymmetric L-shaped antenna, illustrating that at the one-fourth wavelength resonance point, the slot line impedance is zero as is the reactance of the L-shaped antenna, with the slot line impedance canceling L-shaped antenna reactance at greater frequencies, thus to provide adequate broadband gain for the antenna; and, FIG. 7 is a graph of VSWR versus frequency for the subject asymmetric L-shaped antenna having a lower portion of its vertically upstanding plate shunted to the ground plane for the antenna.

The above cancellation of impedance and reactance is shown in FIG. 6, in which the slot line impedance 80 is graphed against the "L" antenna reactance 82 such that at the ¼-wavelength reactance point 84, these curves cross the zero reactance line. To the right of the ¼-wavelength reactance point 84, the slot line impedance cancels the L-shaped antenna reactance, thus to provide for the gain characteristic shown by Table I set forth hereinafter.

TABLE I

| MHz | Meander line-less MLA | Conventional Symmetric MLA |
|---|---|---|
| 60 | −13.2 DBI | −13 DBI |
| 70 | −4.8 | −6.2 |
| 80 | −3.5 | −4.0 |
| 90 | −0.6 | −0.5 |
| 100 | +0.6 | +1.0 |
| 120 | 2.5 | 2.0 |
| 140 | 3.9 | 3.0 |
| 160 | 2.8 | 4.0 |
| 180 | 5.2 | 3.0 |
| 200 | 4.1 | 4.7 |
| 240 | 3.8 | 3.0 |
| 260 | 4.1 | 3.6 |
| 300 | 3.7 | 4.0 |

What will be seen is that over the entire bandwidth from 830 MHz up to over 3 GHz, the gain of the antenna is acceptable.

Figure 7:
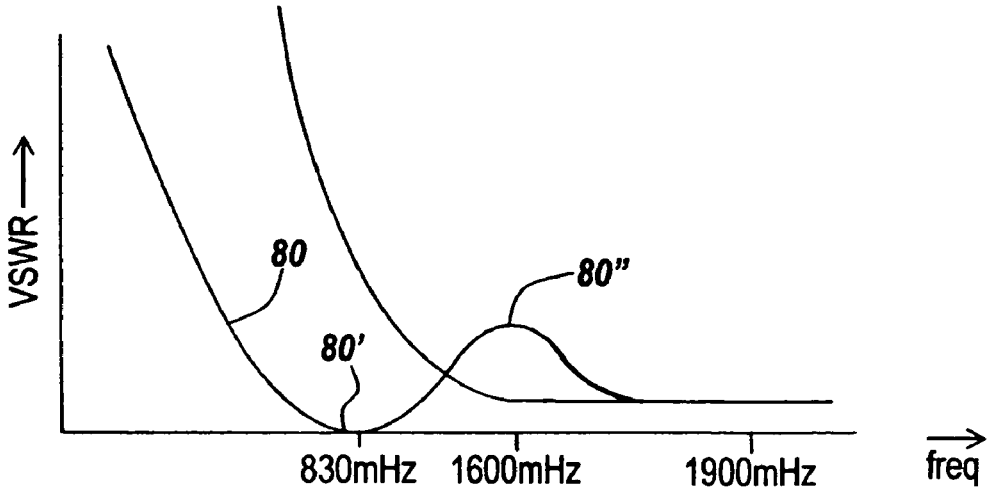

Referring to FIG. 7, the slot line impedance 80 may be made to dip as illustrated at 80' through the utilization of the aforementioned shunt of the vertically extending plate of the L-shaped antenna to ground. In this case, however, the VSWR increases at, for instance, 1.6 GHz as illustrated at 80." This is not an issue when one is seeking to operate a cell phone or a PDA in the 830 MHz band and the 1.9 GHz band.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An asymmetric L-shaped slotted meander line-less broadband antenna, comprising:

a ground plane;

L-shaped radiators including a horizontally extending plate parallel to said ground plane and a vertically extending plate having an upper edge spaced from an edge of said horizontally extending plate so as to form a slot;

a short across said slot adjacent one end thereof;

a capacitive element positioned across said slot adjacent the other end thereof; and, a feed point for said antenna between said ground plane and said vertically extending plate.

2. The antenna of claim 1, wherein said antenna has a ¼ wave point, said short and capacitive element configured such that the impedance of the slot line is close to zero at said ¼ wave point.

3. The antenna of claim 2, wherein said short and capacitive element are configured to maximize slot line impedance and radiator reactance cancellation across the bandwidth of said antenna.

4. The antenna of claim 1, and further including a shunt between said vertically extending plate and said ground plane.

5. The antenna of claim 4, wherein said last mentioned shunt was between a lower corner of said vertically extending plate and said ground plane, thus to increase antenna gain at the low frequency end of said antenna.

6. The antenna of claim 1, wherein said antenna is a miniaturized antenna having dimensions suitable for use in a hand-held device.

7. The antenna of claim 6, wherein said hand-held device includes a clamshell housing and wherein said miniaturized antenna is housed within one of the clamshell portions.

8. The antenna of claim 1, wherein said antenna is tuned for maximum broadband gain by movement of said short along said slot.

9. The antenna of claim 1, wherein said antenna is tuned for maximum broadband gain by movement of said capacitive element along said slot.

10. The antenna of claim 1, wherein said capacitive element is an L-shaped element.

11. The antenna of claim 10, wherein said L-shaped capacitive element has two orthogonal plates positioned across mid-slot such that said orthogonal plates are spaced from associated sides of said vertically and horizontally extending plates said orthogonal plates overlie.

12. The antenna of claim 11, wherein said antenna is tuned to maximum broadband gain by the spacing of said orthogonal plates from respective vertically and horizontally extending plates.

13. The antenna of claim 1, wherein said antenna is tuned for maximum broadband gain by the physical configuration of said capacitive element.

14. A method of reducing the cost of a broadband L-shaped slotted antenna having its broadband response created by a meander line across the two orthogonally oriented plates that create the L-shaped antenna, comprising the step of substituting for the meander line an asymmetric assemblage of a short across one end of the slot formed by the two orthogonally oriented plates and a capacitive shunt across the other end of the slot, the assemblage mimicking the action of the removed meander line.

15. The method of claim 14, wherein the antenna has a ground plane and further including shunting of one of the orthogonal plates to the ground plane.

16. A method of canceling transmission line impedance with the reactance of an L-shaped antenna across the operating bandwidth of the antenna, comprising the steps of:

spacing apart two orthogonally oriented antenna radiators so as to form a slot between the adjacent edges of the radiators;

bridging one end of the slot with a short adjacent the one end; and shunting the other end of the slot with a capacitive element, thus to form an asymmetrical L-shaped broadband antenna.

17. The method of claim 16, and further including the step of adjusting the position of the short to maximize broadband gain of the antenna.

18. The method of claim 16, and further including adjusting the position of the capacitive element to maximize broadband gain of the antenna.

19. A miniaturized broadband antenna for use in a PDA, comprising:

a ground plane;

L-shaped radiators including a horizontally extending plate parallel to said ground plane and a vertically extending plate having an upper edge spaced from an edge of said horizontally extending plate so as to form a slot;

a short across said slot adjacent one end thereof;

a capacitive element positioned across said slot adjacent the other end thereof; and, a feed point for said antenna between said ground plane and said vertically extending plate.

20. A miniaturized broadband antenna for use in an ultra-wideband transceiver comprising:

a ground plane;

L-shaped radiators including a horizontally extending plate parallel to said ground plane and a vertically extending plate having an upper edge spaced from an edge of said horizontally extending plate so as to form a slot;

a short across said slot adjacent one end thereof;

a capacitive element positioned across said slot adjacent the other end thereof; and, a feed point for said antenna between said ground plane and said vertically extending plate.

* * * * *